US011670841B2

(12) United States Patent
Lee et al.

(10) Patent No.: US 11,670,841 B2
(45) Date of Patent: Jun. 6, 2023

(54) VEHICLE ANTENNA MOUNTING SYSTEM

(71) Applicants: HYUNDAI MOTOR COMPANY, Seoul (KR); KIA CORPORATION, Seoul (KR); ACE TECHNOLOGIES CORPORATION, Incheon (KR)

(72) Inventors: Byoung Hyun Lee, Yongin-si (KR); Se Young Park, Seoul (KR); Sang Ho Lee, Hwaseong-si (KR); Jin Kyu Hwang, Incheon (KR)

(73) Assignees: HYUNDAI MOTOR COMPANY, Seoul (KR); KIA CORPORATION, Seoul (KR); ACE TECHNOLOGIES CORPORATION, Incheon (KR)

( * ) Notice: Subject to any disclaimer, the term of this patent is extended or adjusted under 35 U.S.C. 154(b) by 0 days.

(21) Appl. No.: 17/403,442

(22) Filed: Aug. 16, 2021

(65) Prior Publication Data

US 2022/0131259 A1 Apr. 28, 2022

(30) Foreign Application Priority Data

Oct. 26, 2020 (KR) ..... 10-2020-0139589

(51) Int. Cl.
*H01Q 1/32* (2006.01)
*H01Q 1/12* (2006.01)

(52) U.S. Cl.
CPC ..... *H01Q 1/3275* (2013.01); *H01Q 1/1214* (2013.01)

(58) Field of Classification Search
CPC .. H01Q 1/3275; H01Q 1/1214; H01Q 1/1207; F16B 2200/20; F16B 2200/205
See application file for complete search history.

(56) References Cited

U.S. PATENT DOCUMENTS

2018/0309184 A1* 10/2018 Iwakami ..... H01Q 1/1207

FOREIGN PATENT DOCUMENTS

KR 101803257 B1 11/2017

* cited by examiner

*Primary Examiner* — Robert Karacsony
(74) *Attorney, Agent, or Firm* — Lempia Summerfield Katz LLC

(57) ABSTRACT

A vehicle antenna mounting system, including an antenna circuit board, an antenna base supporting the antenna circuit board, an antenna cover covering the antenna circuit board, and a temporary mounting member temporarily mounting the antenna base on a roof of a vehicle body. The antenna base has a mounting projection protruding downwardly from a bottom surface of the antenna base and a cavity defined in the mounting projection. The temporary mounting member is received in the cavity and the roof has a hole into which the temporary mounting member is inserted.

15 Claims, 26 Drawing Sheets

VEHICLE ANTENNA MOUNTING SYSTEM

CROSS-REFERENCE TO RELATED APPLICATION

This application is based on and claims the benefit of priority to Korean Patent Application No. 10-2020-0139589, filed on Oct. 26, 2020, in the Korean Intellectual Property Office, the disclosure of which is incorporated herein in its entirety by reference.

TECHNICAL FIELD

The present disclosure relates to a vehicle antenna mounting system, and more particularly, to a vehicle antenna mounting system capable of preventing the separation of an antenna base from the roof of a vehicle before the antenna base is fully connected to a roof of a vehicle body through a bolt and a nut.

BACKGROUND

A vehicle may have a vehicle antenna for communications, and the vehicle antenna may be mounted on a roof of a vehicle body through a bolt and a nut.

The vehicle antenna may include an antenna circuit board, an antenna base supporting the antenna circuit board, and an antenna cover covering the antenna circuit board. The antenna circuit board may have a plurality of antenna elements, patch antennas, and the like for communications, signal transmission and reception, and the like. The antenna base may be mounted on the roof of the vehicle body through the bolt and the nut, and the antenna cover may protect the antenna circuit board.

The antenna base may be temporarily mounted on the roof of the vehicle by a plurality of temporary mounting members. Then the antenna base may be fully connected to the roof of the vehicle by the bolt and the nut.

The plurality of temporary mounting members may be connected to the antenna base by a plurality of screws. As the plurality of temporary mounting members are inserted into a hole of the roof, the antenna base may be temporarily assembled to the roof.

However, when the antenna base is connected to the roof by the bolt and the nut, each temporary mounting member may easily be separated from the hole of the roof, which makes the assembly of the vehicle antenna difficult.

In addition, as the plurality of temporary mounting members are connected to the antenna base by the plurality of screws, the costs of components/parts, processing, and the like may increase.

As the plurality of temporary mounting members protrude upwardly from the antenna base, the plurality of temporary mounting members may interfere with the elements of the circuit board, which may reduce a circuit pattern usage rate of the circuit board.

The above information described in this background section is provided to assist in understanding the background of the inventive concept, and may include any technical concept which is not considered as the prior art that is already known to those having ordinary skill in the art.

SUMMARY

The present disclosure has been made to solve the above-mentioned problems occurring in the prior art while maintaining advantages achieved by the prior art.

An aspect of the present disclosure provides a vehicle antenna mounting system capable of preventing an antenna base from being separated from a roof of a vehicle body by tightly fastening the antenna base using fasteners (e.g., a bolt and a nut) in a state in which the antenna base and the roof are temporarily assembled and connected through a temporary mounting member.

According to an aspect of the present disclosure, a vehicle antenna mounting system may include: an antenna circuit board; an antenna base supporting the antenna circuit board; an antenna cover covering the antenna circuit board; and a temporary mounting member temporarily mounting the antenna base on a roof of a vehicle body. The antenna base may have a mounting projection protruding downwardly from a bottom surface of the antenna base and a cavity defined in the mounting projection. The temporary mounting member may be received in the cavity and the roof may have a hole into which the temporary mounting member is inserted.

The temporary mounting member may include: a head; a pair of center legs extending from the center of the head; and a pair of edge legs extending from both edges of the head, respectively.

The pair of center legs may be spaced apart from each other and be parallel to each other. Each center leg may be elastically bent and connected to the head and the center leg may have a center retention barb provided on a bottom end thereof.

Each edge leg may have an edge retention barb provided on a bottom end thereof.

Each edge leg may have an inner surface facing the pair of center legs and an outer surface facing the outside of the head. The edge leg may have a plurality of inner recesses provided on the inner surface and a plurality of outer recesses provided on the outer surface.

The plurality of inner recesses may be recessed from the inner surface toward the outer surface and the plurality of outer recesses may be recessed from the outer surface toward the inner surface.

The edge retention barb may have a first inclined surface and a second inclined surface opposing the first inclined surface. A slope of the first inclined surface may be steeper than that of the second inclined surface.

The head may have a positioning recess and the antenna base may have a positioning projection protruding toward the cavity. When the temporary mounting member is received in the cavity, the positioning projection may be fitted into the positioning recess.

The cavity may include: an upper cavity receiving the head; a center cavity receiving the pair of center legs; and a pair of edge cavities receiving the pair of edge legs, respectively.

The cavity may include a retention shoulder provided in the center cavity. The pair of center legs may be engaged with the retention shoulder.

When the head is received in the upper cavity, a top surface of the head may be flush with a top surface of the antenna base.

Each edge leg may further include a straight portion extending vertically.

The temporary mounting member may have a head and an opening provided in the head and may include a pair of edge legs extending from both edges of the head, respectively. A screw may pass through the opening and be screwed into the antenna base.

The vehicle antenna mounting system may further include a stopper projection protruding downwardly from a bottom surface of the roof along a peripheral edge of the hole.

BRIEF DESCRIPTION OF THE DRAWINGS

The above and other objects, features, and advantages of the present disclosure should be more apparent from the following detailed description taken in conjunction with the accompanying drawings.

DETAILED DESCRIPTION

Figure 1:
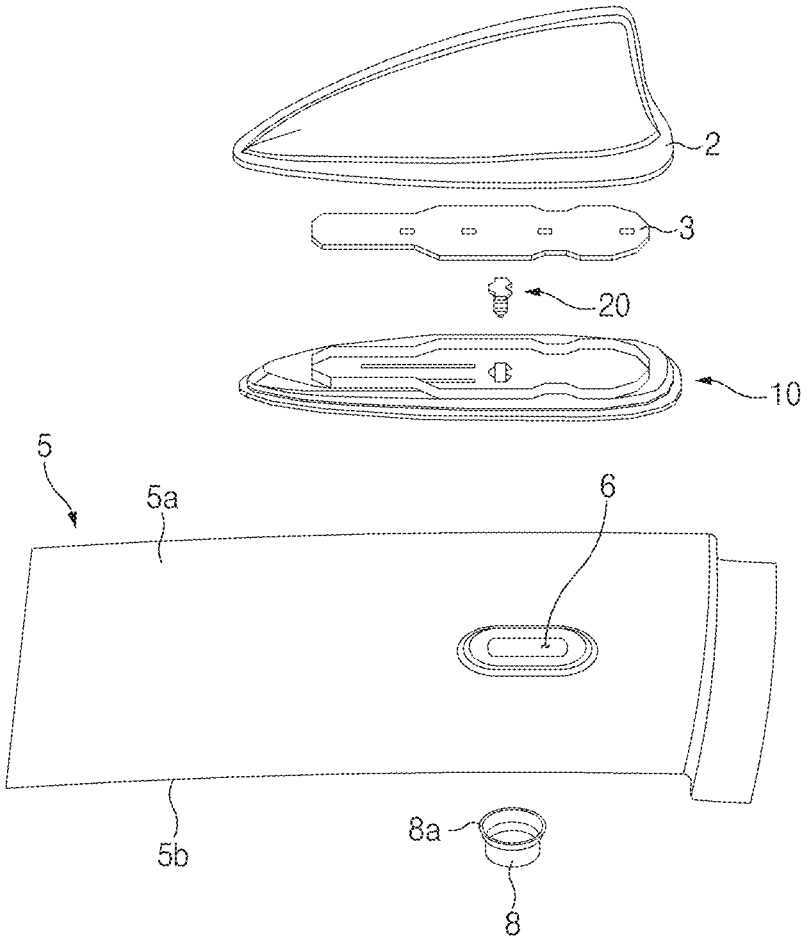
FIG. 1 illustrates an exploded perspective view of a vehicle antenna mounting system according to an embodiment of the present disclosure.

Hereinafter, embodiments of the present disclosure are described in detail with reference to the accompanying drawings. In the drawings, the same reference numerals are used throughout to designate the same or equivalent elements. In addition, a detailed description of well-known techniques associated with the present disclosure have been omitted in order not to unnecessarily obscure the gist of the present disclosure.

Terms such as first, second, A, B, (a), and (b) may be used to describe the elements in embodiments of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those having ordinary skill in the field of art to which the present disclosure belongs. Such terms as those defined in a generally used dictionary are to be interpreted as having meanings consistent with the contextual meanings in the relevant field of art. Such terms are not to be interpreted as having ideal or excessively formal meanings unless clearly defined as having such in the present application.

FIG. 1 illustrates an exploded perspective view of a vehicle antenna mounting system according to an embodiment of the present disclosure.

Referring to FIG. 1, a vehicle antenna according to an embodiment of the present disclosure may include an antenna circuit board 3, an antenna base 10 supporting the antenna circuit board 3, and an antenna cover 2 covering the antenna circuit board 3.

Figure 19:
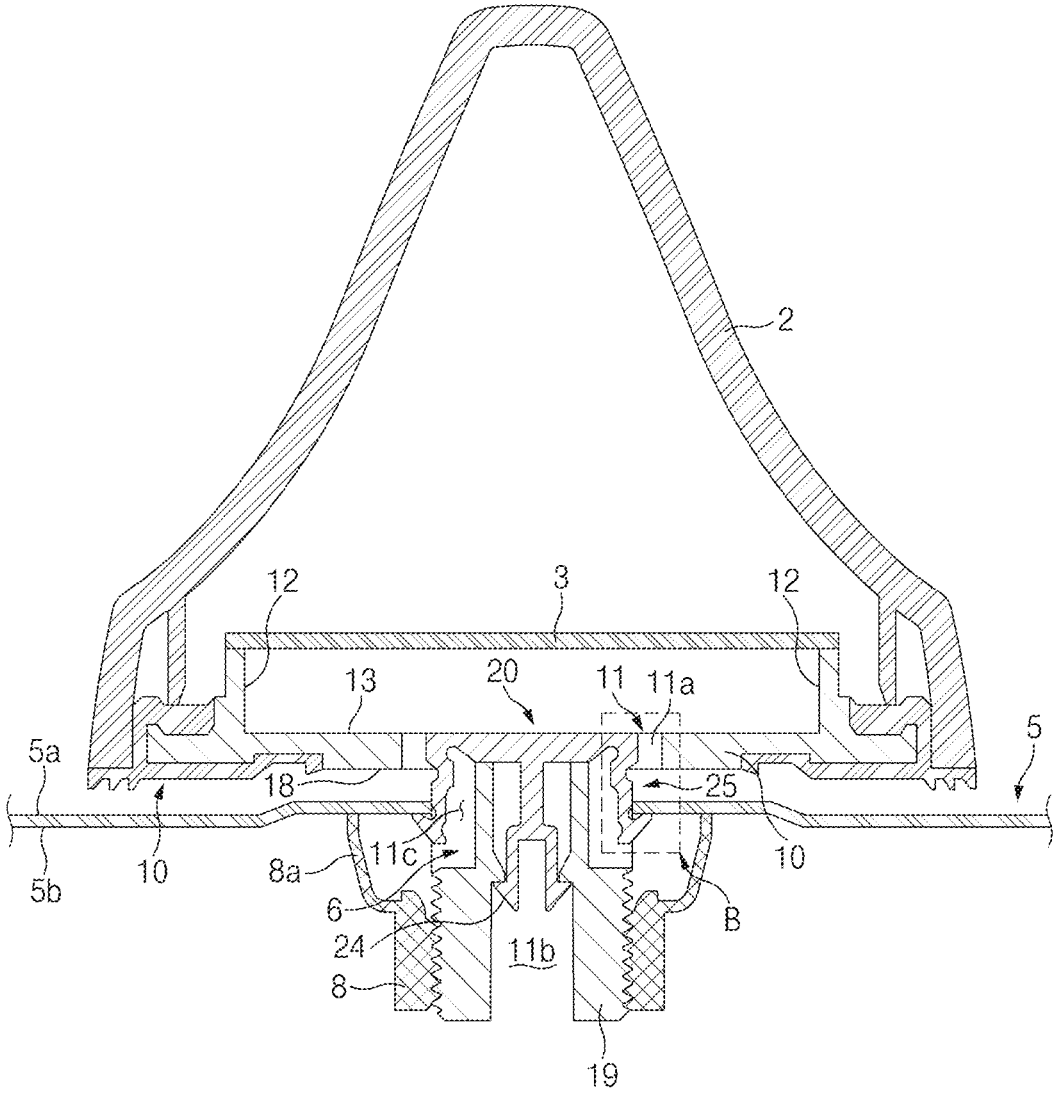
FIG. 19 illustrates a cross-sectional view of a state in which an antenna base is fully connected to a roof as a nut is tightly fastened to a stud bolt of the antenna base.

The antenna circuit board 3, the antenna base 10, and the antenna cover 2 may constitute the vehicle antenna. The antenna circuit board 3 may have a plurality of antenna elements, patch antennas, and the like for communications, signal transmission and reception, and the like. Referring to FIG. 19, the antenna base 10 may be completely mounted on a roof 5 of a vehicle body through a stud bolt 19 and a nut 8. The antenna cover 2 may protect the antenna circuit board 3.

The vehicle antenna mounting system according to an embodiment of the present disclosure may include a temporary mounting member 20 for temporarily mounting the antenna base 10 on the roof 5 of the vehicle body.

Figure 2:
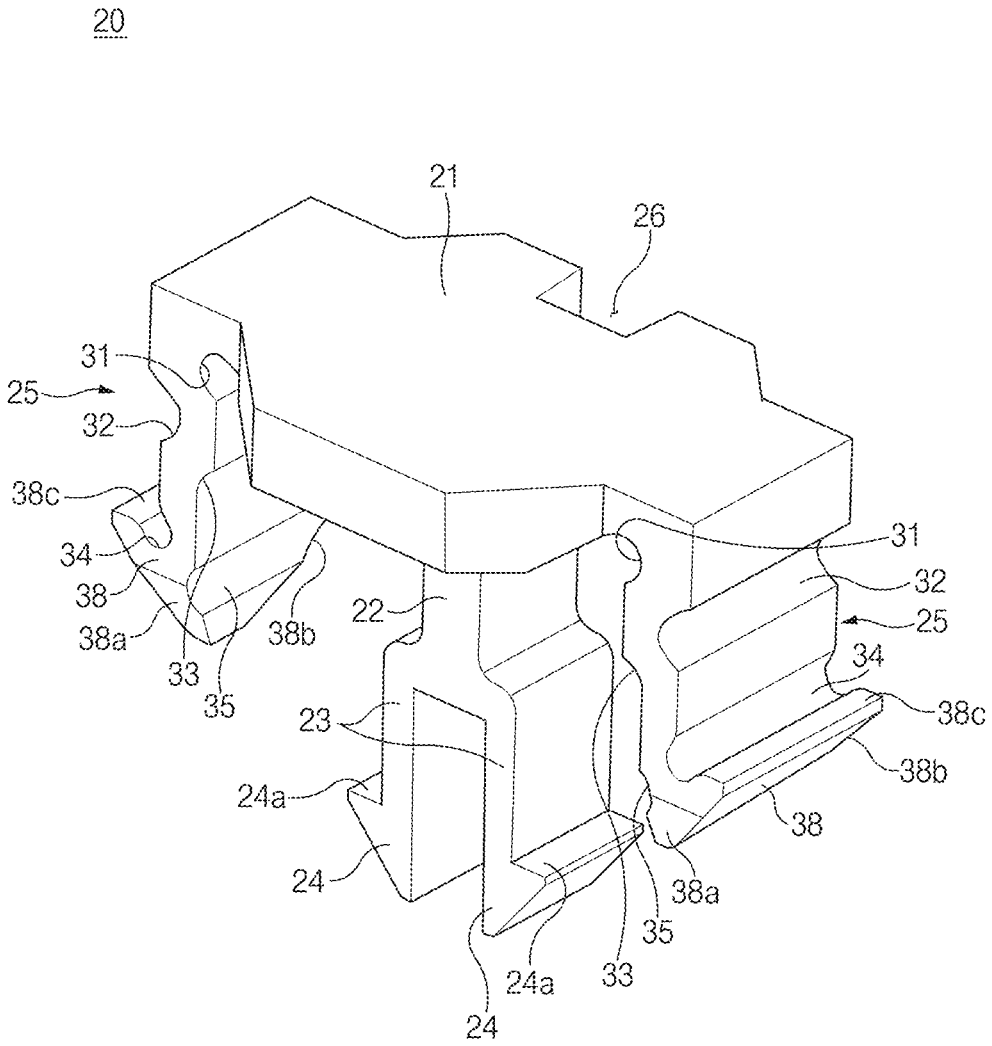
FIG. 2 illustrates a perspective view of a temporary mounting member in a vehicle antenna mounting system according to an embodiment of the present disclosure.
Figure 3:
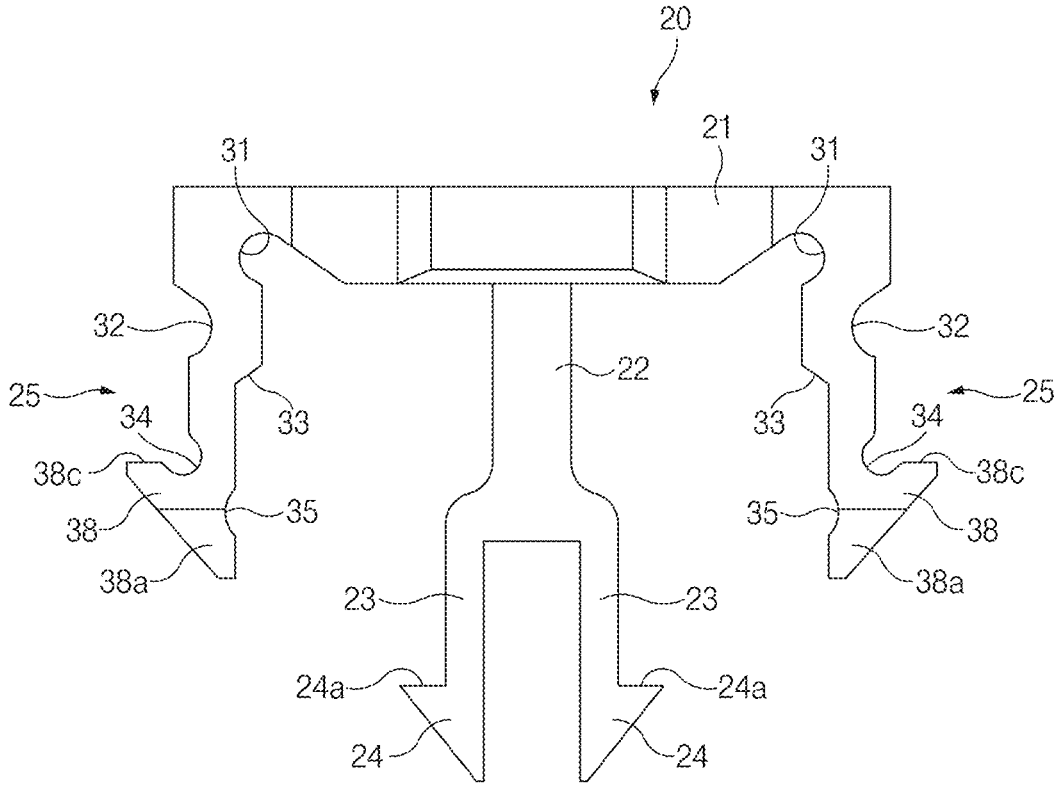
FIG. 3 illustrates a front view of the temporary mounting member illustrated in FIG. 2.
Figure 4:
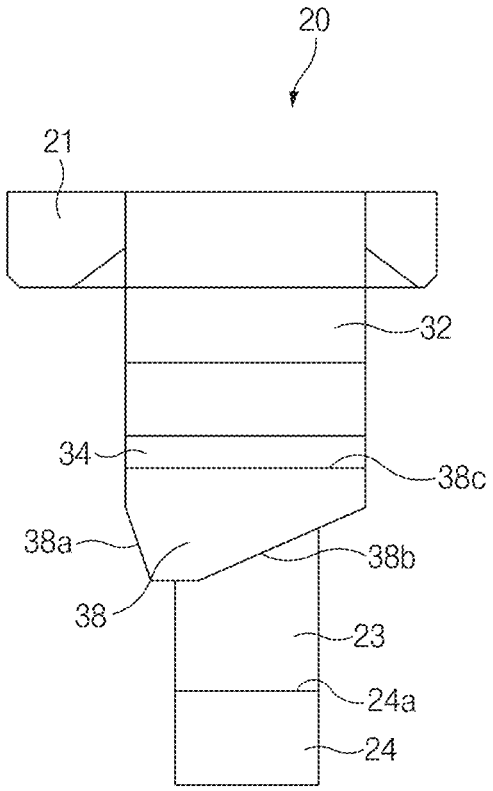
FIG. 4 illustrates a side view of the temporary mounting member illustrated in FIG. 2.
Figure 5:
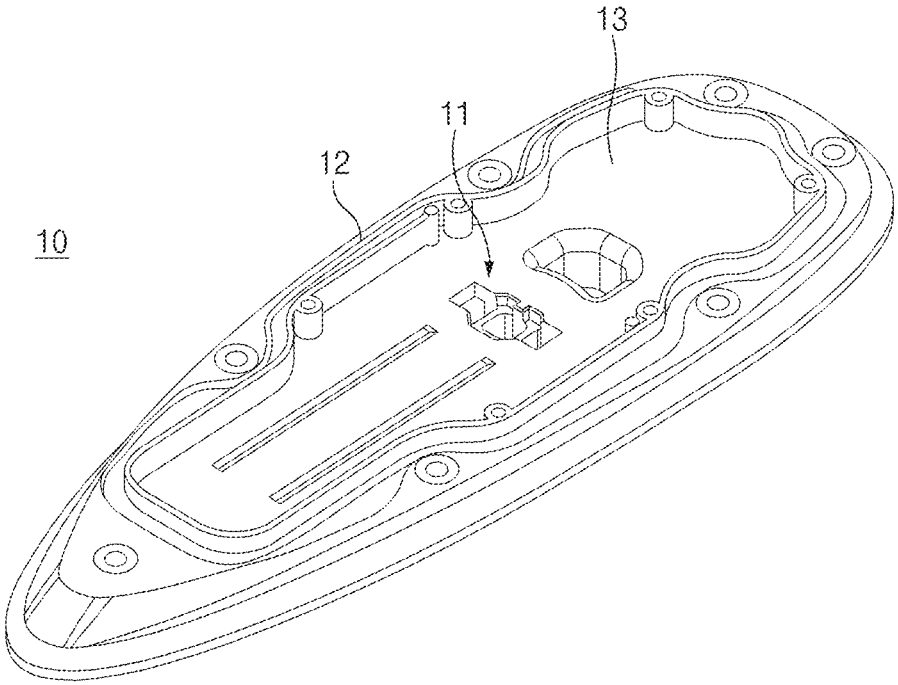
FIG. 5 illustrates a perspective view of an antenna base for a vehicle antenna according to an embodiment of the present disclosure.

Referring to FIGS. 2-4, the temporary mounting member may include a head 21, a center extension portion 22 extending from the center of the head 21, a pair of center legs 23 extending from the center extension portion 22, and a pair of edge legs 25 extending from both edges of the head 21.

The center extension portion 22 may extend vertically from the head 21 and the pair of center legs 23 may be connected to a bottom end of the center extension portion 22. The pair of center legs 23 may be spaced apart from each other and be parallel to each other. Each center leg 23 may be integrally connected to the bottom end of the center extension portion 22 and the pair of center legs 23 may be connected to the head 21 through the center extension portion 22. The center legs 23 may be elastically bent (deformed). Each center leg 23 may have a center retention barb 24 provided on a bottom end thereof and the center retention barb 24 may have a flat engagement surface 24*a*.

Each edge leg 25 may have an inner surface facing the pair of center legs 23 and an outer surface facing the outside of the head 21. In particular, the edge leg 25 may have a plurality of inner recesses 31, 33, and 35 which are recessed from the inner surface toward the outer surface and may have a plurality of outer recesses 32 and 34 which are recessed from the outer surface toward the inner surface. The plurality of inner recesses 31, 33, and 35 may face the center of the head 21 and the plurality of outer recesses 32 and 34 may face the outside of the head 21. Accordingly, each edge leg 25 may have curves by the plurality of inner recesses 31, 33, and 35 and the plurality of outer recesses 32 and 34.

The plurality of inner recesses 31, 33, and 35 may include a first inner recess 31 located on a top end of each edge leg 25, a second inner recess 33 located below the first inner recess 31, and a third inner recess 35 located below the second inner recess 33. The plurality of outer recesses 32 and 34 may include a first outer recess 32 located between the first inner recess 31 and the second inner recess 33 and may include a second outer recess 34 located between the second inner recess 33 and the third inner recess 35.

Each edge leg 25 may have an edge retention barb 38 provided on a bottom end thereof and the edge retention barb 38 may have a flat engagement surface 38*c*.

Referring to FIGS. 2 and 4, the edge retention barb 38 may have a first inclined surface 38*a* and a second inclined surface 38*b* opposing the first inclined surface 38*a*. For example, the first inclined surface 38*a* may face the front of the temporary mounting member 20 or the front of the vehicle and the second inclined surface 38*b* may face the rear of the temporary mounting member 20 or the rear of the vehicle. A slope of the first inclined surface 38*a* may be steeper than that of the second inclined surface 38*b*. In other words, the first inclined surface 38*a* and the second inclined surface 38*b* may have an asymmetrical shape.

Referring to FIGS. 5-17, the antenna base 10 may include a top surface 13, a bottom surface 18 opposing the top surface 13, a support wall 12 extending along an edge of the top surface 13, and a sealing portion 17 extending along an edge of the bottom surface 18.

Figure 6:
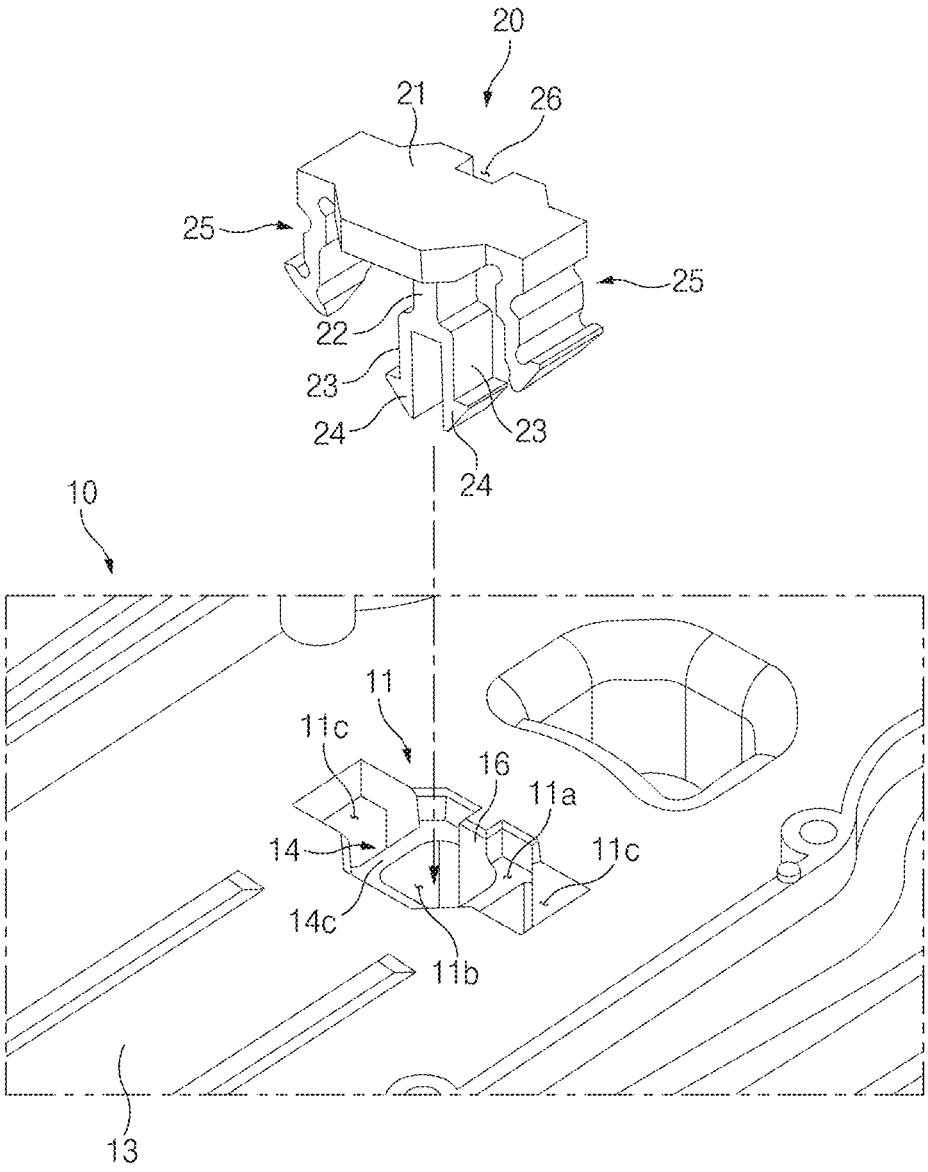
FIG. 6 illustrates a perspective view of the separation of the temporary mounting member from a cavity of the antenna base illustrated in FIG. 5.
Figure 9:
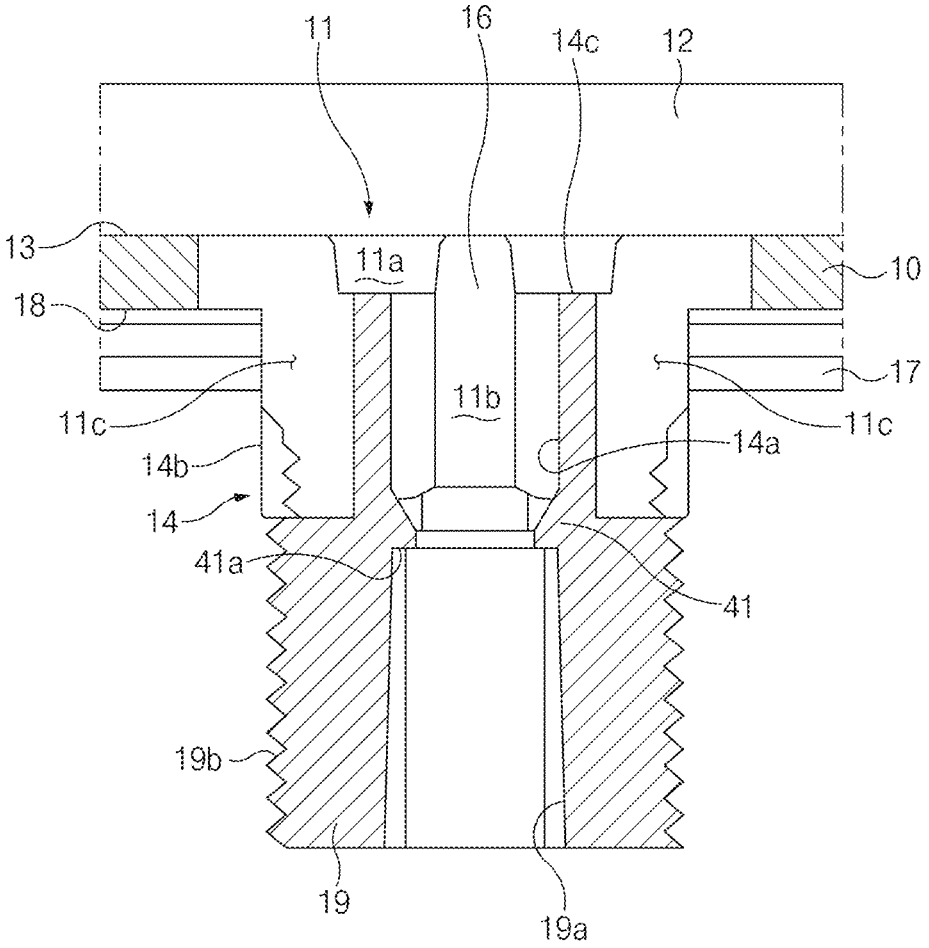
FIG. 9 illustrates a cross-sectional view taken along line A-A of FIG. 8.

Referring to FIGS. 6 and 9, the antenna base 10 may have a cavity 11 in which the temporary mounting member 20 is received. The cavity 11 may be recessed from the top surface 13 of the antenna base 10 toward the bottom surface 18 of the antenna base 10. The cavity 11 may include an upper cavity 11*a* receiving the head 21, a center cavity 11*b* receiving the center extension portion 22 and the pair of center legs 23, and a pair of edge cavities 11*c* receiving the pair of edge legs 25, respectively.

Figure 7:
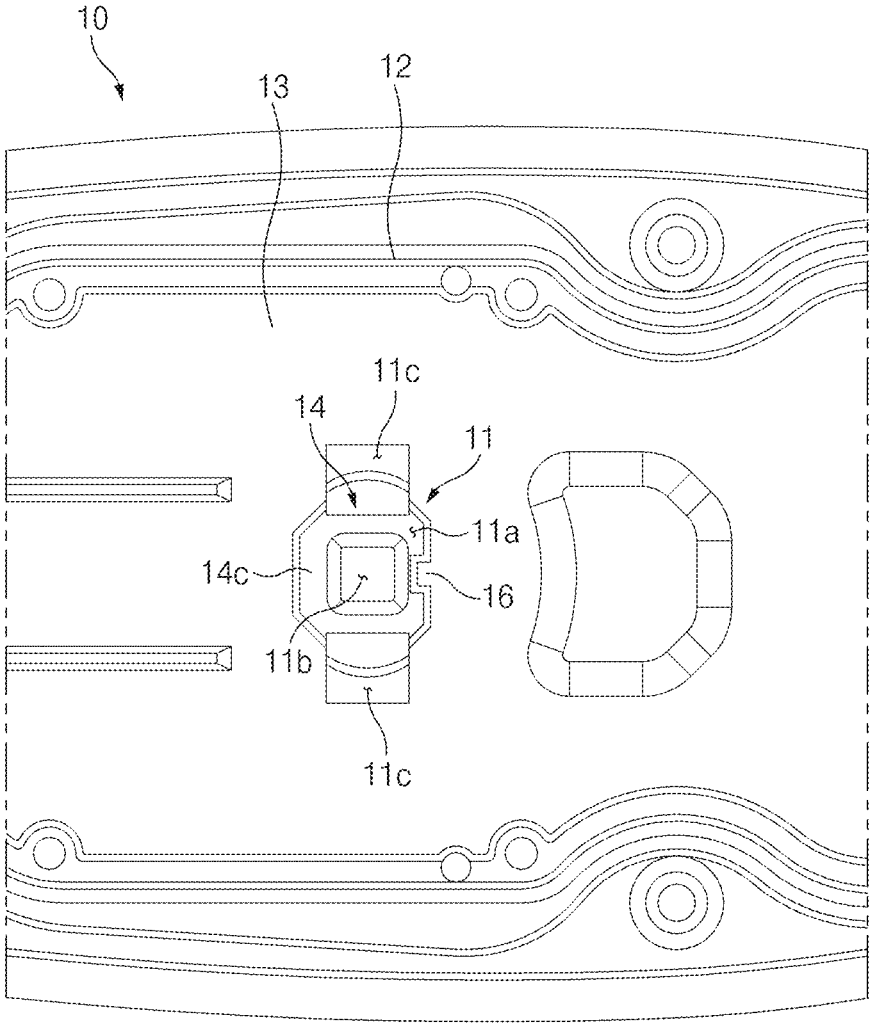
FIG. 7 illustrates a plan view of the antenna base illustrated in FIG. 6.
Figure 8:
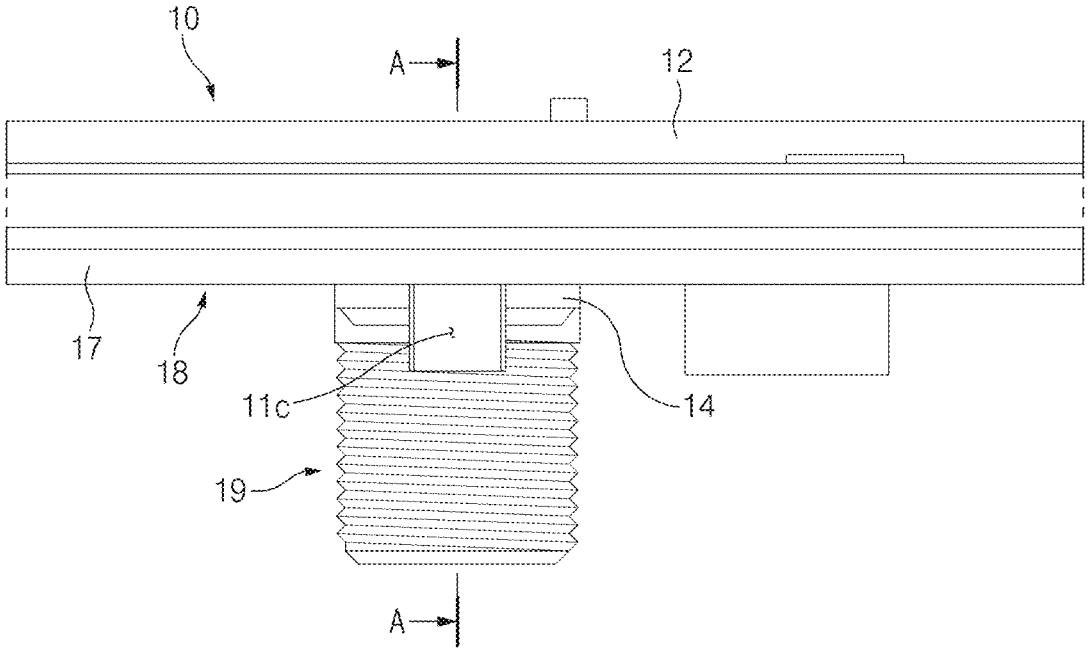
FIG. 8 illustrates a side view of the antenna base illustrated in FIG. 7.

Referring to FIGS. 6-9, the antenna base 10 may have a mounting projection 14 protruding downwardly from the bottom surface 18 of the antenna base 10. The cavity 11 may be defined in the mounting projection 14. Referring to FIG. 8, the stud bolt 19 may be integrally connected to a bottom end of the mounting projection 14. Accordingly, the stud bolt 19 may be located below the bottom surface 18 of the antenna base 10.

Referring to FIG. 9, the mounting projection 14 may have an inner peripheral surface 14*a* and an outer peripheral surface 14*b*. A seat surface 14*c* may be provided on a top end surface of the mounting projection 14. As the seat surface 14*c* of the mounting projection 14 is recessed from the top surface 13 of the antenna base 10 toward the bottom surface 18 of the antenna base 10, the upper cavity 11*a* may be defined by the seat surface 14*c* of the mounting projection 14. The stud bolt 19 may have an inner peripheral surface 19*a* and an outer peripheral surface. An external thread 19*b* may be provided on the outer peripheral surface of the stud bolt 19. The center cavity 11*b* may be defined in the center of the mounting projection 14. The center cavity 11*b* may extend along a central axis of the mounting projection 14 and a central axis of the stud bolt 19. The inner peripheral surface 14*a* of the mounting projection 14 and the inner peripheral surface 19*a* of the stud bolt 19 may define the center cavity 11*b*. The pair of edge cavities 11*c* may be symmetrical to each other with respect to the central axis of the mounting projection 14. Each edge cavity 11*c* may be recessed from the outer peripheral surface 14*b* of the mounting projection 14 toward the inner peripheral surface 14*a* of the mounting projection 14. The edge cavity 11*c* may be open to the outside of the mounting projection 14.

The antenna base 10 may have a retention shoulder 41 provided in the center cavity 11*b*. The retention shoulder 41 may protrude from the inner peripheral surface 14*a* of the mounting projection 14 toward the center cavity 11*b* and the retention shoulder 41 may have a flat engagement surface 41*a*. The retention shoulder 41 may extend along the inner peripheral surface 14*a* of the mounting projection 14. In particular, the retention shoulder 41 may be located between the inner peripheral surface 14*a* of the mounting projection 14 and the inner peripheral surface 19*a* of the stud bolt 19.

Figure 10:
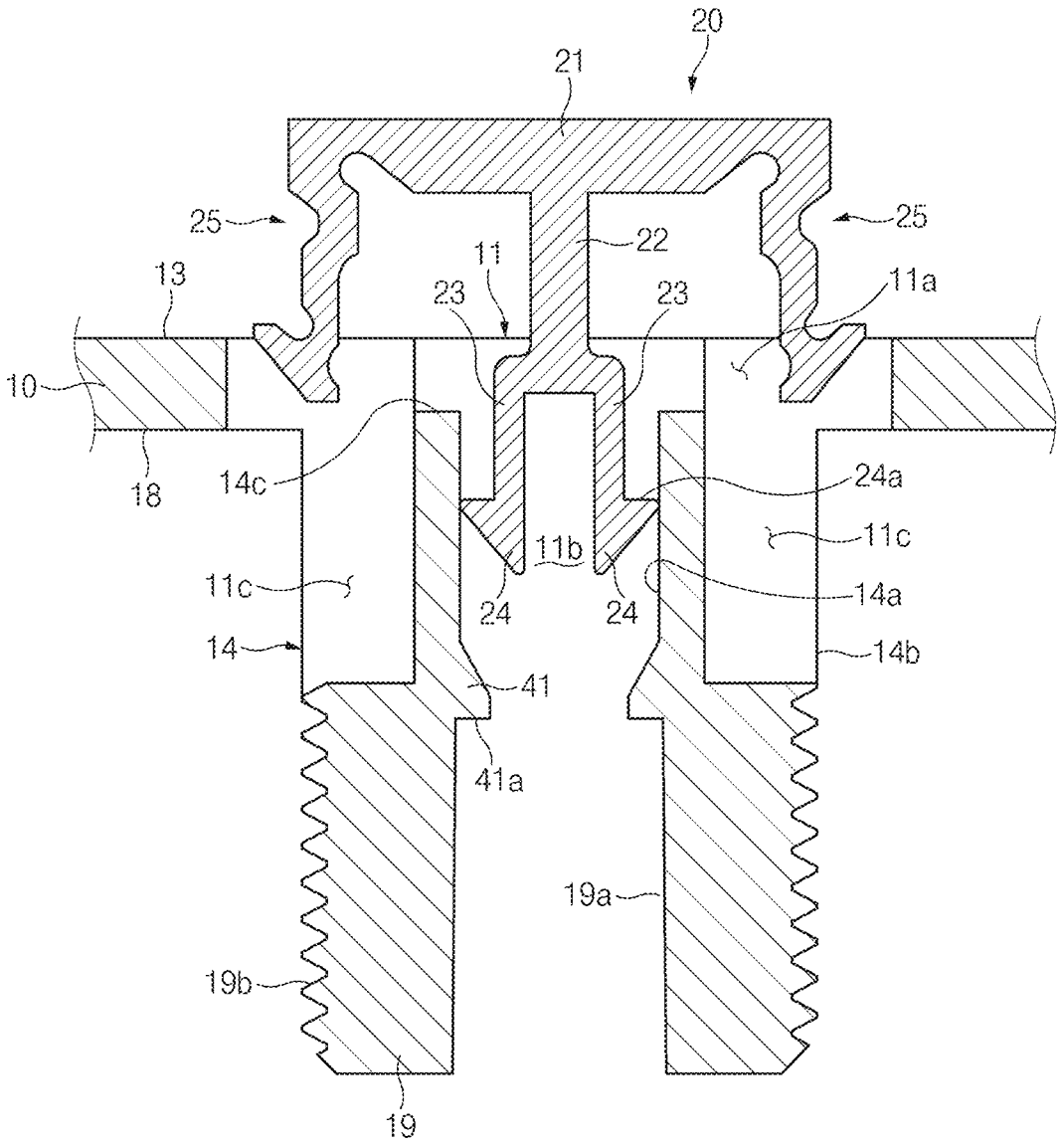
FIG. 10 illustrates a state in which center legs and edge legs of the temporary mounting member are initially received in a cavity.
Figure 11:
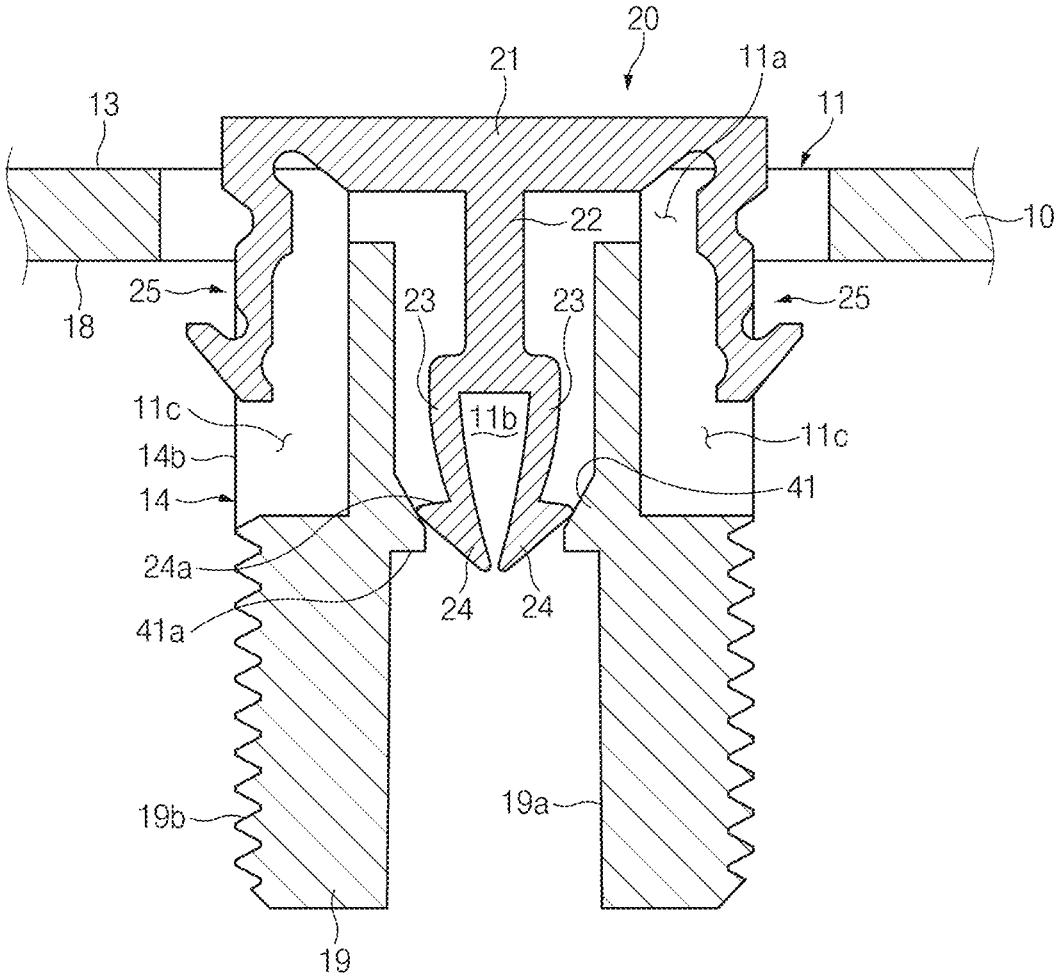
FIG. 11 illustrates a state in which center legs of a temporary mounting member are bent by a retention shoulder.
Figure 12:
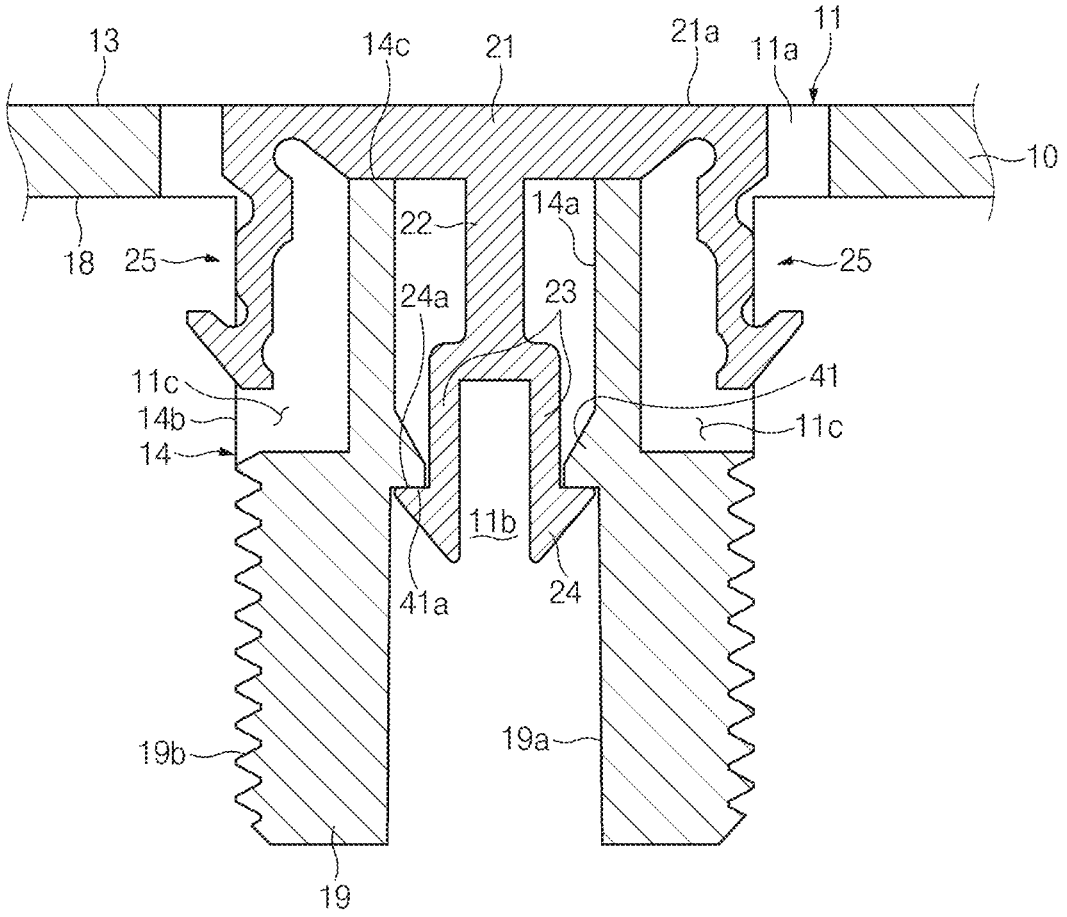
FIG. 12 illustrates a state in which a temporary mounting member has fully been received in a cavity.

Referring to FIGS. 10-12, the temporary mounting member 20 may be received in the cavity 11 of the antenna base 10. FIG. 10 illustrates a state in which the center legs 23 and the edge legs 25 of the temporary mounting member 20 are initially received in the cavity 11. FIG. 11 illustrates a state in which the center legs 23 of the temporary mounting member 20 are bent by the retention shoulder 41. FIG. 12 illustrates a state in which the temporary mounting member 20 has fully been received in the cavity 11.

When the temporary mounting member 20 is initially received in the cavity 11 as illustrated in FIG. 10, the center legs 23 and the edge legs 25 of the temporary mounting member 20 may not be deformed. As illustrated in FIG. 11, as the center retention barbs 24 of the temporary mounting member 20 come into contact with the retention shoulder 41 located in the center cavity 11*b*, the center legs 23 may be bent. As illustrated in FIG. 12, as the engagement surfaces 24*a* of the center retention barbs 24 are engaged with the engagement surface 41*a* of the retention shoulder 41, the center retention barbs 24 of the temporary mounting member 20 may be retained in the center cavity 11*b* by the retention shoulder 41. Thus, the temporary mounting member 20 may be fitted in the cavity 11.

Referring to FIG. 12, when the head 21 of the temporary mounting member 20 is received in the upper cavity 11*a*, a bottom surface of the head 21 of the temporary mounting member 20 may be seated on the seat surface 14*c*. The head 21 of the temporary mounting member 20 may have a thickness corresponding to a distance between the top surface 13 of the antenna base 10 and the seat surface 14*c* of the mounting projection 14 (that is, a thickness of the upper cavity 11*a*). When the head 21 of the temporary mounting member 20 is received in the upper cavity 11*a*, a top surface 21*a* of the head 21 may be flush with the top surface 13 of the antenna base 10.

Referring to FIGS. 2 and 6, the head 21 may have a positioning recess 26. Referring to FIGS. 6, 7, and 9, the antenna base 10 may have a positioning projection 16 protruding toward the cavity 11. The positioning projection 16 may be received in the positioning recess 26 of the temporary mounting member 20. The positioning projection 16 may have a shape and a size corresponding to those of the positioning recess 26. When the temporary mounting member 20 is received in the cavity 11, the positioning projection 16 may be fitted into the positioning recess 26 so that a mounting position of the temporary mounting member 20 may be accurately determined.

Figure 13:
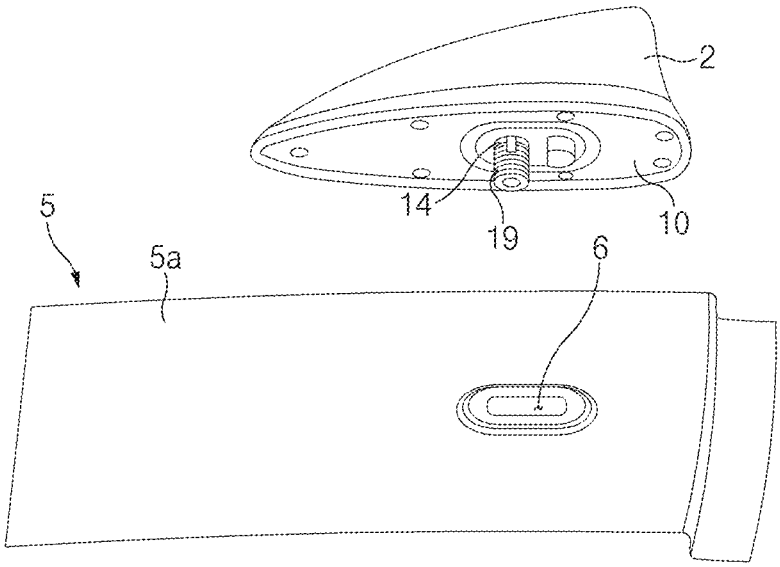
FIG. 13 illustrates a state before a stud bolt of an antenna base is inserted into a hole of a roof of a vehicle body.
Figure 15:
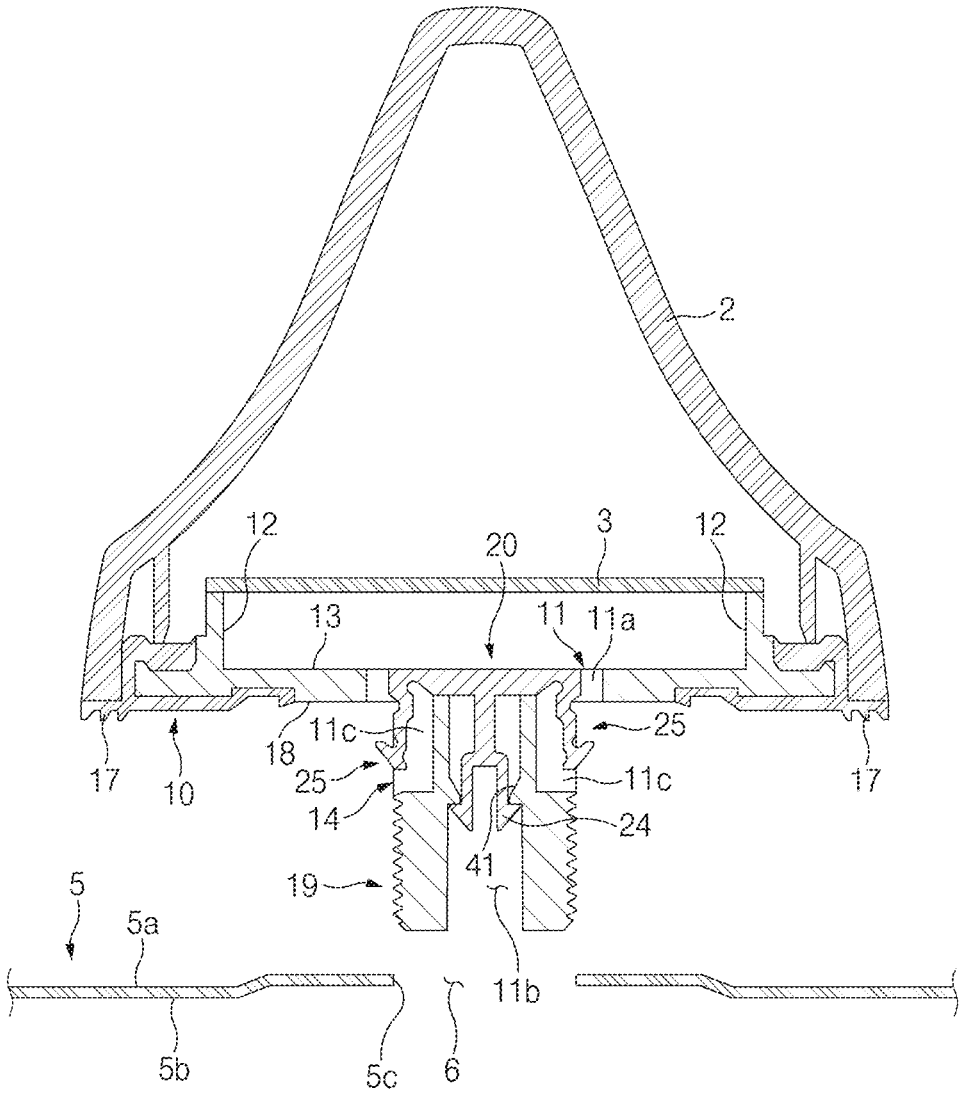
FIG. 15 illustrates a cross-sectional view of a state before a stud bolt of an antenna base is inserted into a hole of a roof.

Referring to FIGS. 13 and 15, the antenna circuit board 3 may be supported by the support wall 12 of the antenna base 10. The antenna cover 2 may be mounted on the antenna base 10 to cover the antenna circuit board 3. The temporary mounting member 20 may be received in the cavity 11 of the antenna base 10. After the antenna cover 2, the antenna circuit board 3, and the temporary mounting member 20 are mounted on the antenna base 10, the temporary mounting member 20 and the stud bolt 19 of the antenna base 10 may be inserted into a hole 6 of the roof 5 of the vehicle body.

Figure 14:
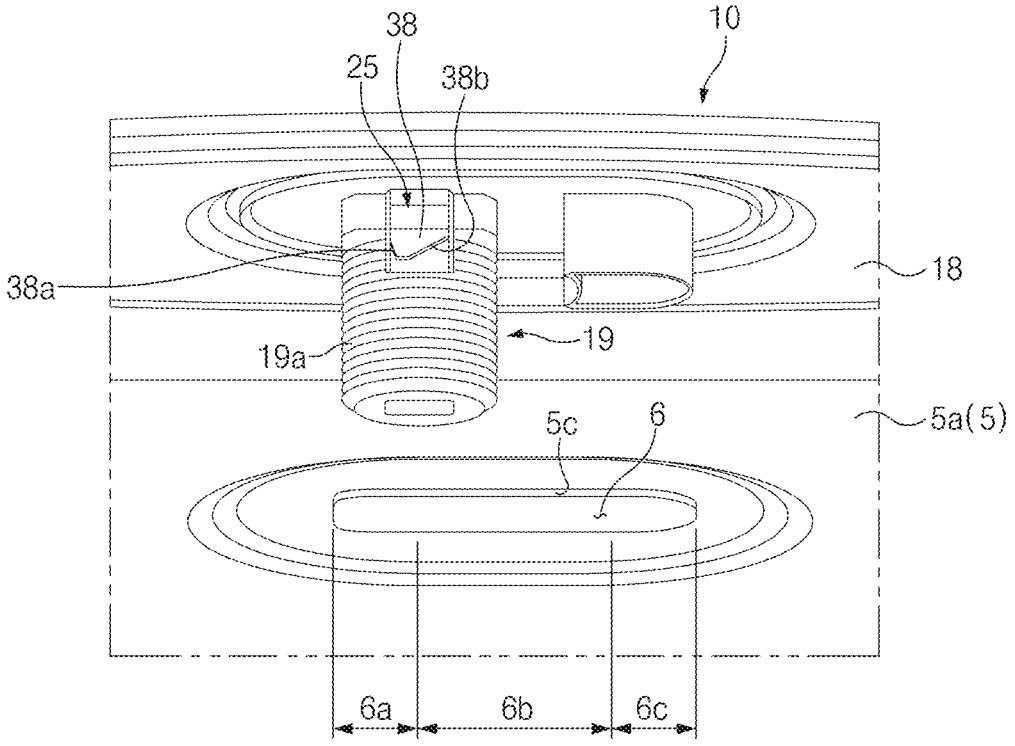
FIG. 14 illustrates an enlarged view of a stud bolt of an antenna base and a hole of a roof of a vehicle body.

Referring to FIG. 14, the hole 6 of the roof 5 may include a front area 6*a* facing the front of the antenna and the front of the vehicle, a rear area 6*c* facing the rear of the antenna and the rear of the vehicle, and a center area 6*b* located between the front area 6*a* and the rear area 6*c*. A peripheral edge of the front area 6*a* of the hole 6 may have higher stiffness than a peripheral edge of the center area 6*b* of the hole 6, and the stud bolt 19 may be inserted into the front area 6*a* of the hole 6. When the stud bolt 19 is inserted into the front area 6*a* of the hole 6, the edge leg 25 of the temporary mounting member 20 may come into contact with the peripheral edge of the front area 6*a* in the hole 6 of the roof 5.

When the temporary mounting member 20 passes through the hole 6 of the roof 5, the first inclined surface 38*a* of the edge retention barb 38 may first come into contact with the peripheral edge of the front area 6*a*. Accordingly, the edge leg 25 may be deformed toward the rear of the temporary mounting member 20. As the first inclined surface 38*a* having a relatively steep slope comes into contact with the peripheral edge of the front area 6*a*, deformation of the roof 5 may be minimized, and deformation and restoration of the edge leg 25 of the temporary mounting member 20 may be facilitated. For example, as the slope of the first inclined surface 38*a* is made at an acute angle of less than 45°, the deformation of the roof 5 may be further reduced, and the deformation and restoration of the edge leg 25 may be easier.

Figure 16:
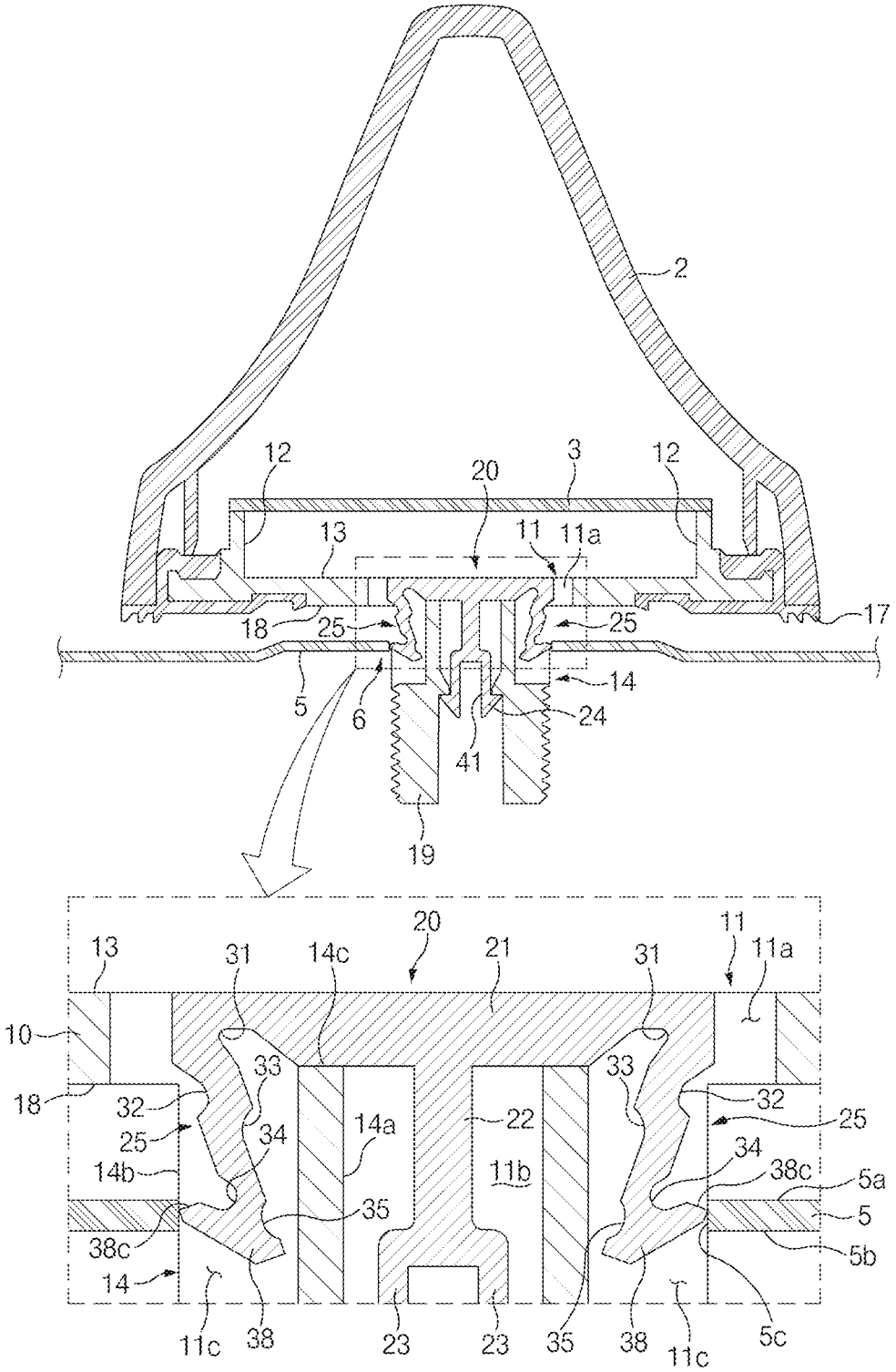
FIG. 16 illustrates a cross-sectional view of a state in which a temporary mounting member and a stud bolt of an antenna base are passing through a hole of a roof.
Figure 17:
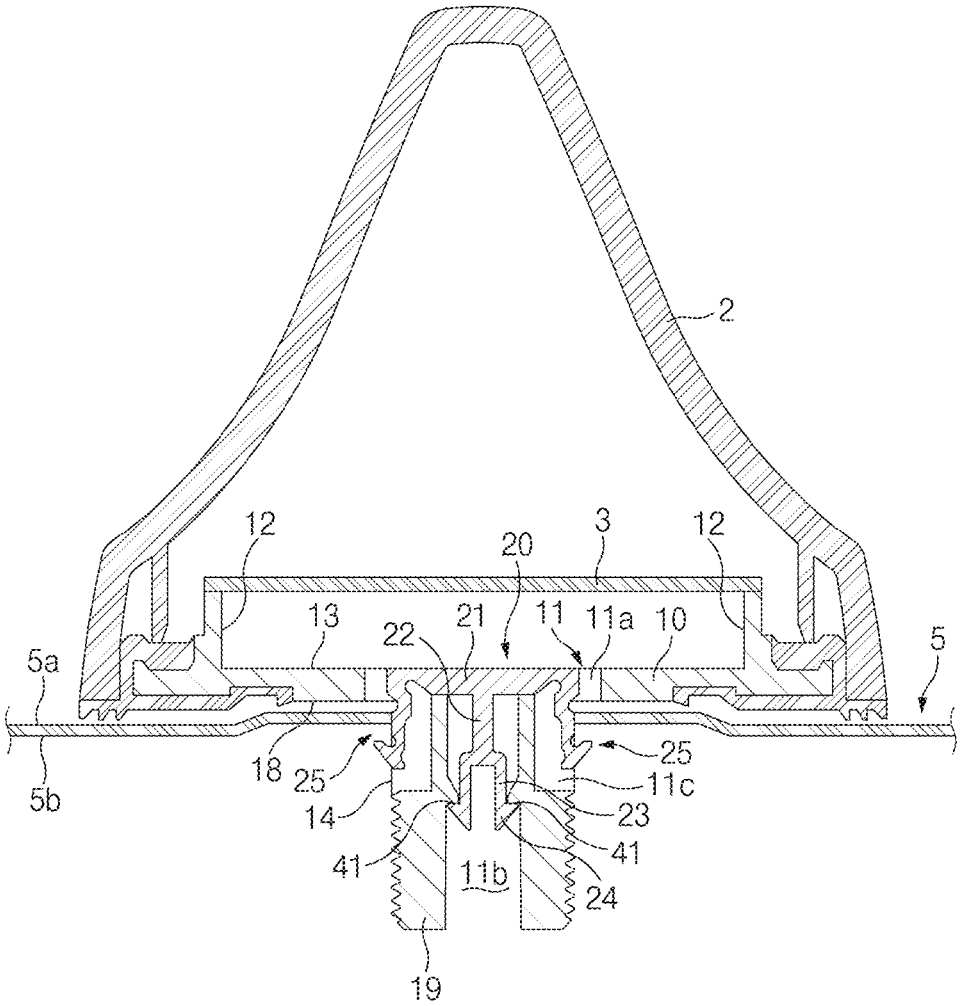
FIG. 17 illustrates a cross-sectional view of a state in which a temporary mounting member and a stud bolt of an antenna base have fully been inserted into a hole of a roof.

FIGS. 15-17 illustrate a process of sequentially inserting the temporary mounting member 20 and the stud bolt 19 of the antenna base 10 into the hole 6 of the roof 5. FIG. 15 illustrates a state before the temporary mounting member 20 and the stud bolt 19 of the antenna base 10 are inserted into the hole 6 of the roof 5. FIG. 16 illustrates a state in which the temporary mounting member 20 and the stud bolt 19 of the antenna base 10 are passing through the hole 6 of the roof 5. FIG. 17 illustrates a state in which the temporary mounting member 20 and the stud bolt 19 of the antenna base 10 have fully been inserted into the hole 6 of the roof 5.

Figure 18:
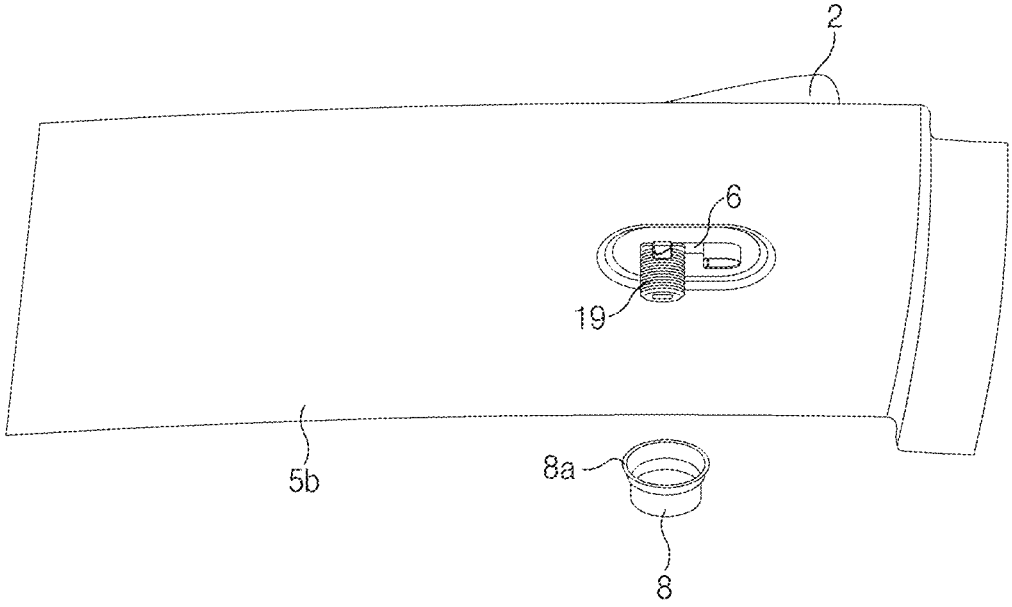
FIG. 18 illustrates a perspective view of a state in which a stud bolt of an antenna base fully extends downward through a hole of a roof before a nut is tightly fastened.

As illustrated in FIG. 15, the stud bolt 19 of the antenna base 10 may move toward the hole 6 of the roof 5. Then, as illustrated in FIG. 16, when the stud bolt 19 of the antenna base 10 passes through the hole 6 of the roof 5, the temporary mounting member 20 may come into contact with a peripheral edge 5*c* of the hole 6 of the roof 5, and the edge legs 25 of the temporary mounting member 20 may be bent by the peripheral edge 5*c* of the hole 6. As illustrated in an enlarged view of FIG. 16, the first inner recess 31 may be compressed, the first outer recess 32 may be extended (stretched), the second inner recess may be compressed, the second outer recess 34 may be compressed, and the third inner recess 35 may be extended. Thus, each edge leg 25 may easily be deformed. Referring to FIGS. 17 and 18, when the sealing portion 17 of the antenna base 10 contacts the top surface 5*a* of the roof 5, the temporary mounting member 20 and the stud bolt 19 of the antenna base 10 may be fully inserted into the hole 6 of the roof 5 so that the stud bolt 19 may protrude below the bottom surface 5*b* of the roof 5. Thus, the antenna base 10 may be temporarily assembled to the roof 5 by the temporary mounting member 20, and the stud bolt 19 may fully extend downward through the hole 6 of the roof 5.

Figure 20:
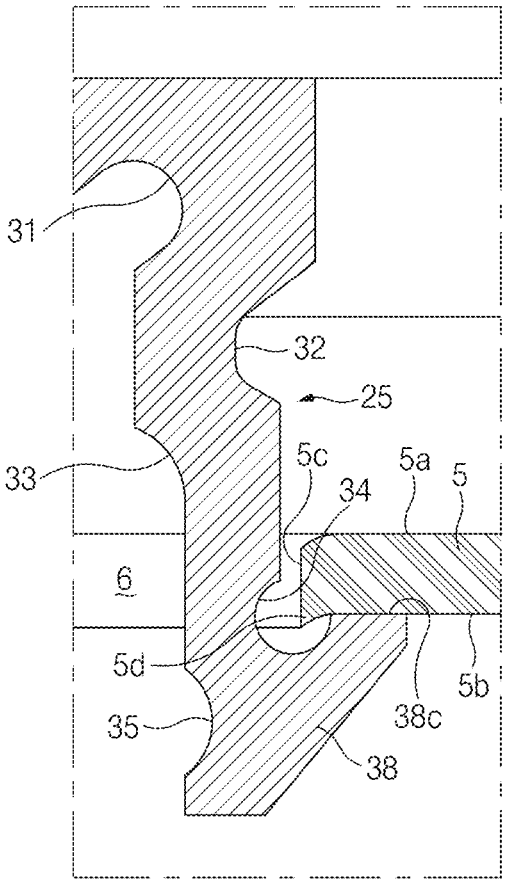
FIG. 20 illustrates an enlarged view of portion B of FIG. 19.

Referring to FIG. 19, after the stud bolt 19 fully extends through the hole 6 of the roof 5, the nut 8 may be tightly fastened to the stud bolt 19 using a tool so that the antenna base 10 may be fully connected to the roof 5. The nut 8 may have a head 8*a* provided on a top end thereof. When the nut 8 is tightly fastened to the stud bolt 19, the head 8*a* of the nut 8 may press the bottom surface 5*b* of the roof 5, and the antenna base 10 may move upward. Referring to FIG. 20, when the nut 8 is tightly fastened to the stud bolt 19, the engagement surface 38*c* of the edge retention barb 38 of each edge leg 25 may be engaged with the bottom surface 5*b* of the roof 5 adjacent to the hole 6 so that the antenna base 10 may be prevented from being separated from the hole 6 of the roof 5. In particular, as the engagement surface 38*c* of the edge retention barb 38 is engaged with the bottom surface 5*b* of the roof 5, the temporary mounting member 20 and the antenna base 10 may be prevented from being separated from the roof 5. By adding an engagement force between the edge retention barb 38 of the temporary mounting member 20 and the bottom surface 5*b* of the roof 5 to a fastening force between the stud bolt 19 and the nut 8, joining stiffness between the antenna base 10 and the roof 5 may be significantly improved.

Referring to FIG. 20, the roof 5 may have a stopper projection 5*d* protruding downwardly from the bottom surface 5*b* of the roof 5 along the peripheral edge 5*c* of the hole 6. As the stopper projection 5*d* is located within the second outer recess 34 of the edge leg 25, a movement of the engagement surface 38*c* of the edge retention barb 38 may be limited by the stopper projection 5*d*. Thus, the edge leg 25 of the temporary mounting member 20 may be prevented from being separated from the hole 6 of the roof 5.

Figure 21:
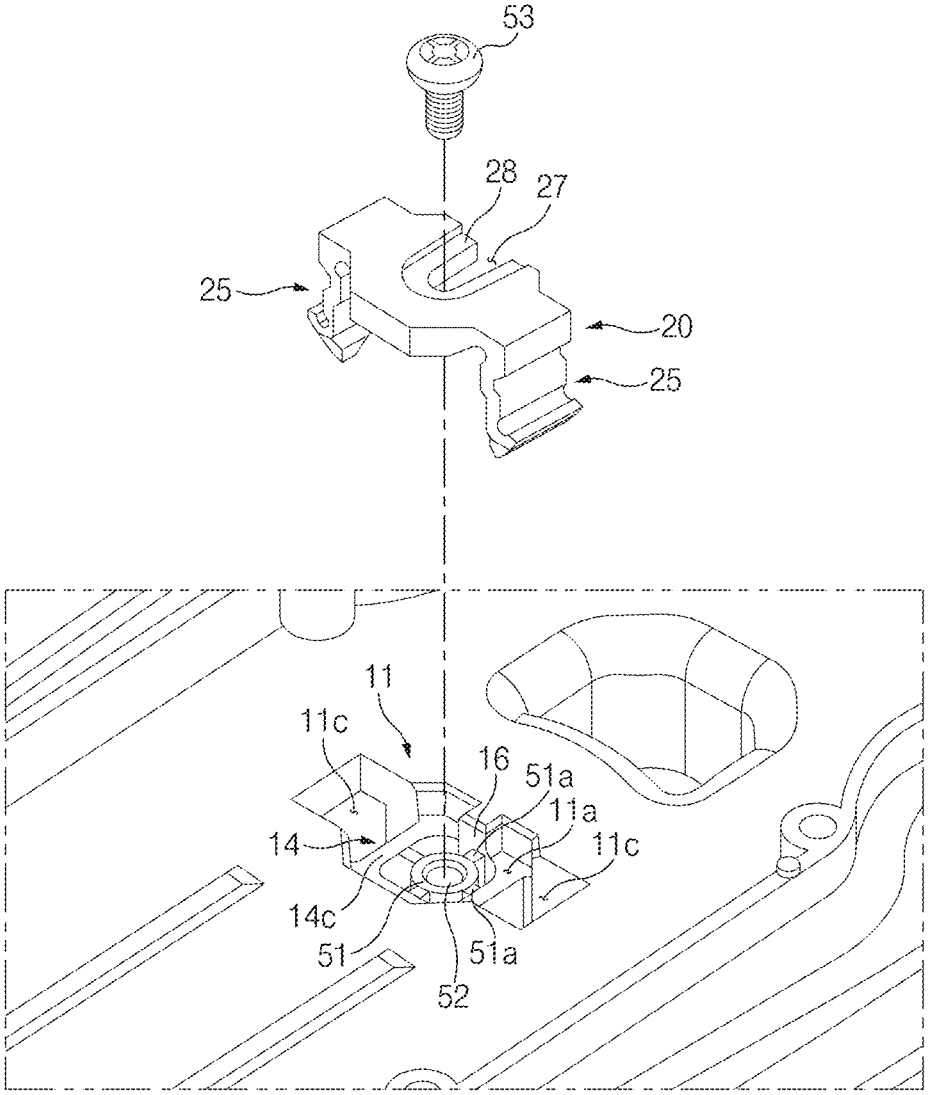
FIG. 21 illustrates an exploded perspective view of a vehicle antenna mounting system according to another embodiment of the present disclosure.
Figure 22:
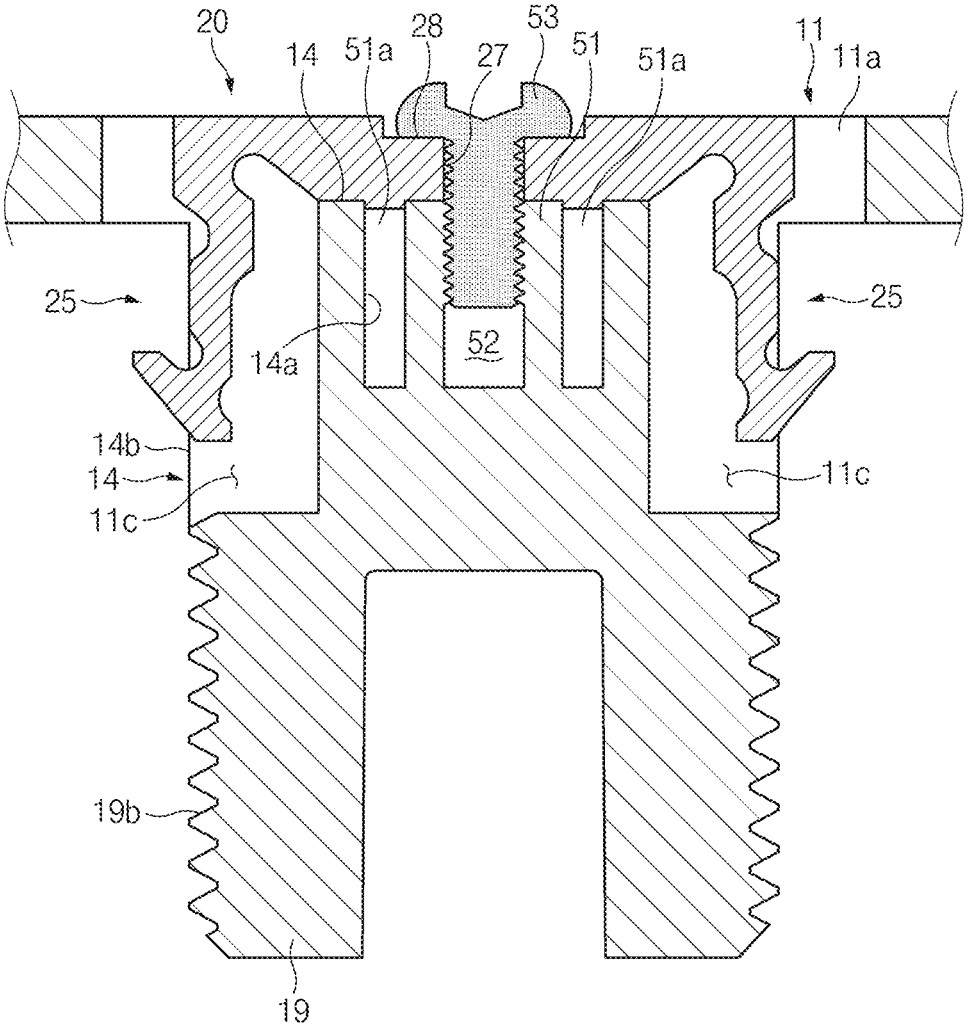
FIG. 22 illustrates a cross-sectional view of a state in which a temporary mounting member is fastened by a screw in a vehicle antenna mounting system according to another embodiment of the present disclosure.

FIGS. 21 and 22 illustrate a vehicle antenna mounting system according to another embodiment of the present disclosure.

Referring to FIGS. 21 and 22, the temporary mounting member 20 may have an opening 27 provided in the head 21, and a support surface 28 may be provided around the opening 27. The antenna base 10 may have a boss 51 provided in the center of the cavity 11, and the boss 51 may have a hole 52 into which a screw 53 is screwed. The boss 51 may be integrally connected to the inner peripheral surface 14*a* of the mounting projection 14 through a rib 51*a*. As the screw 53 passes through the opening 27 of the temporary mounting member 20 and is screwed into the hole 52 of the boss 51, a head portion of the screw 53 may be supported to the support surface 28 of the temporary mounting member 20.

According to the embodiment illustrated in FIGS. 21 and 22, the temporary mounting member 20 may not include the center extension portion 22 and the pair of center legs 23 but may include the pair of edge legs 25 extending from both edges of the head 21 as in the previous embodiment. The other elements in this embodiment may be the same as or similar to those in the previous embodiment.

FIGS. 23-26 illustrate a vehicle antenna mounting system according to another embodiment of the present disclosure.

Figure 23:
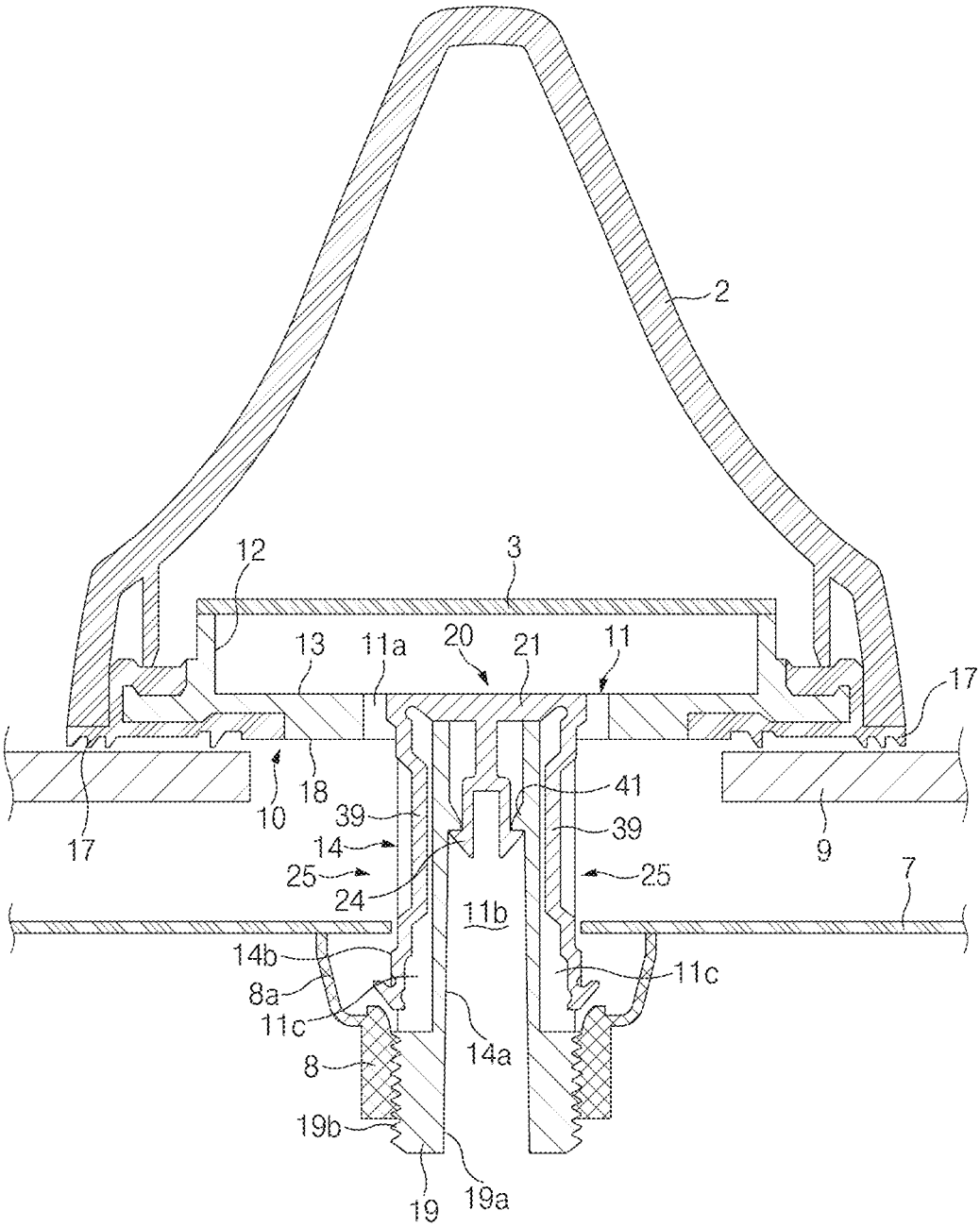
FIG. 23 illustrates a cross-sectional view of a vehicle antenna mounting system according to another embodiment of the present disclosure.
Figure 24:
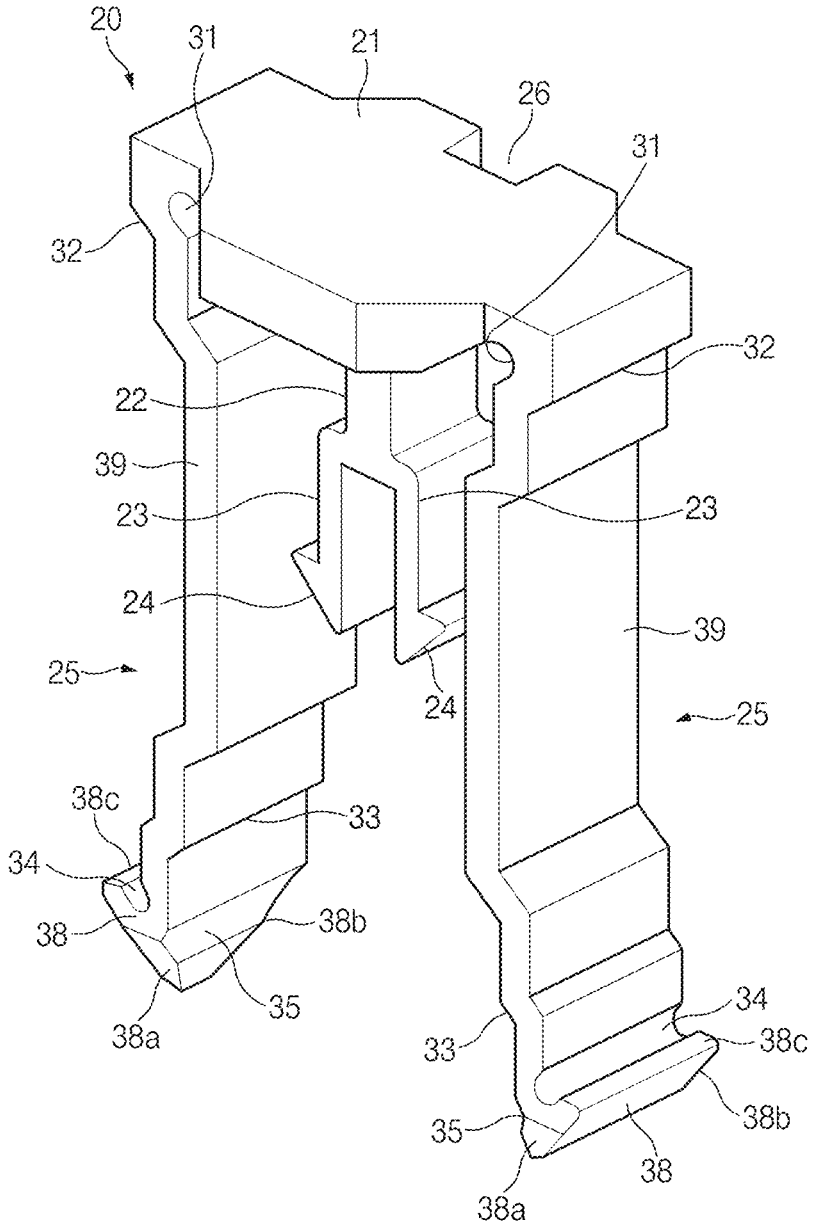
FIG. 24 illustrates a perspective view of the temporary mounting member illustrated in FIG. 23.
Figure 25:
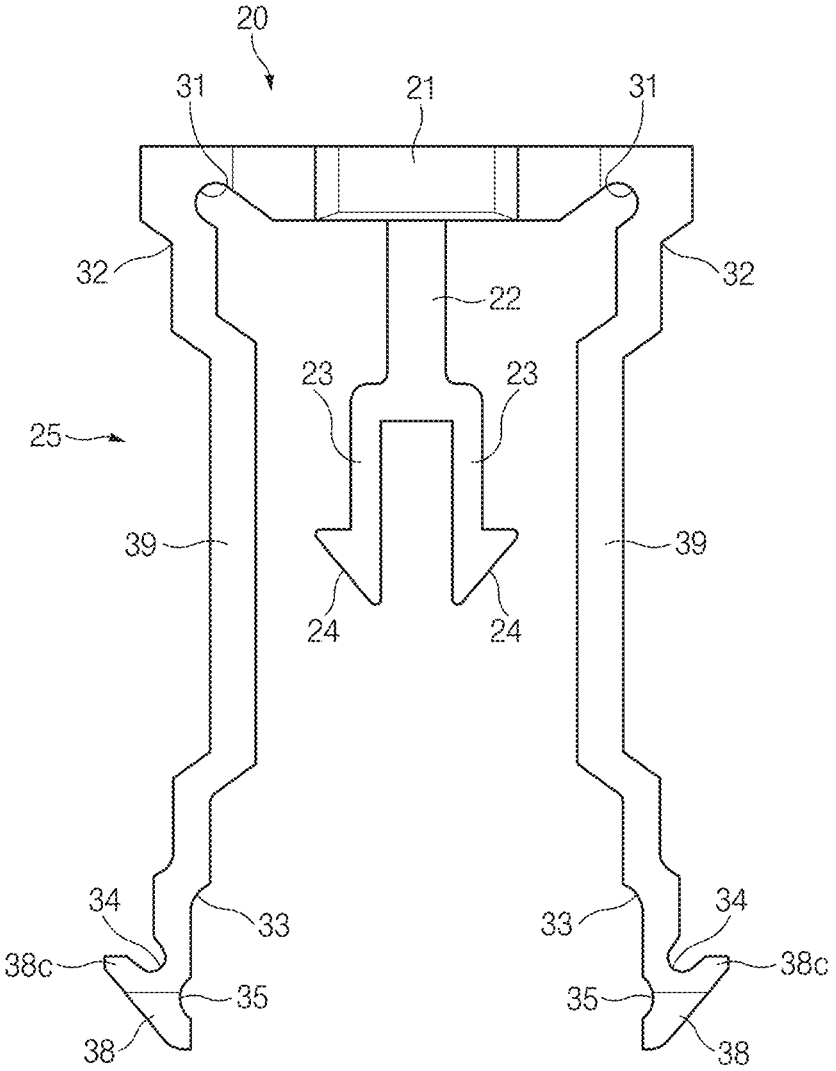
FIG. 25 illustrates a front view of the temporary mounting member illustrated in FIG. 24.
Figure 26:
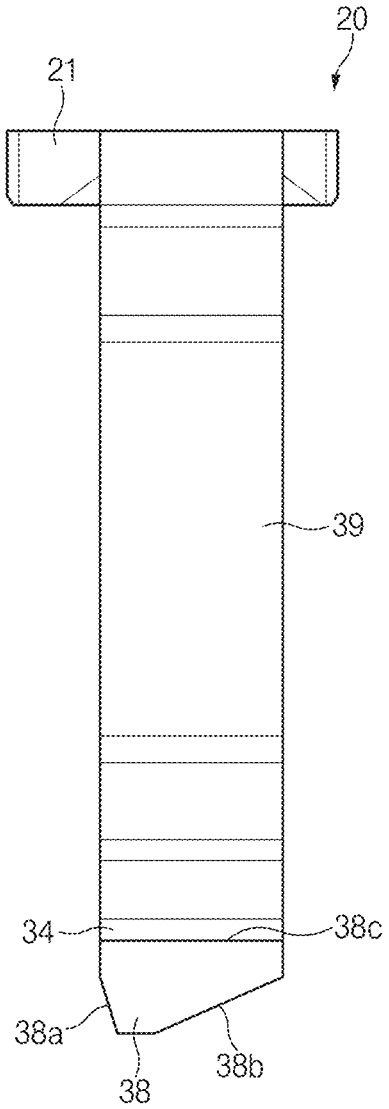
FIG. 26 illustrates a side view of the temporary mounting member illustrated in FIG. 24.

FIG. 23 illustrates a roof structure having a panoramic roof 9 and a roof reinforcement 7. The panoramic roof 9 may be disposed above the roof reinforcement 7, and the panoramic roof 9 may be made of a tempered glass material. The sealing portion 17 of the antenna base 10 may contact a top surface of the panoramic roof 9. The roof reinforcement 7 may be made of a metallic material. As the nut 8 is tightly fastened to the stud bolt 19, the head 8*a* of the nut 8 may come into contact with a bottom surface of the roof reinforcement 7. In this regard, the temporary mounting member 20 may have a predetermined length corresponding to a gap between the panoramic roof 9 and the roof reinforcement 7. Specifically, each edge leg 25 of the temporary mounting member 20 may further include a straight portion 39 extending vertically. The straight portion 39 may have a predetermined length corresponding to the gap between the panoramic roof 9 and the roof reinforcement 7. The straight portion 39 may extend vertically between the first outer recess 32 and the second inner recess 33.

As set forth above, the vehicle antenna mounting system according to embodiments of the present disclosure may prevent the antenna base from being separated from the roof by tightly fastening the antenna base using the fasteners (the stud bolt and the nut) in a state in which the antenna base and the roof are temporarily assembled by the temporary mounting member, thereby improving the joining stiffness between the antenna base and the roof.

Hereinabove, although the present disclosure has been described with reference to several embodiments and the accompanying drawings, the present disclosure is not limited thereto. The embodiments may be variously modified and altered by those having ordinary skill in the art to which the present disclosure pertains without departing from the spirit and scope of the present disclosure claimed in the following claims.

What is claimed is:

1. A vehicle antenna mounting system, comprising:

an antenna circuit board;

an antenna base supporting the antenna circuit board;

an antenna cover covering the antenna circuit board; and a temporary mounting member temporarily mounting the antenna base on a roof of a vehicle body, wherein the antenna base has a mounting projection protruding downwardly from a bottom surface of the antenna base and has a cavity defined in the mounting projection, wherein the temporary mounting member is received in the cavity, wherein the roof has a hole into which the temporary mounting member is inserted, wherein the temporary mounting member includes a head, a pair of center legs extending from the center of the head, and a pair of edge legs extending from opposing edges of the head, respectively, and wherein the cavity includes an upper cavity receiving the head, a center cavity receiving the pair of center legs, and a pair of edge cavities receiving the pair of edge legs, respectively.

2. The vehicle antenna mounting system according to claim 1, wherein the pair of center legs are spaced apart from each other and parallel to each other, wherein each center leg of the pair of center legs is elastically bent and connected to the head, and wherein each center leg has a center retention barb provided on a bottom end thereof.

3. The vehicle antenna mounting system according to claim 1, wherein each edge leg of the pair of edge legs has an edge retention barb provided on a bottom end thereof.

4. The vehicle antenna mounting system according to claim 3, wherein the edge retention barb has a first inclined surface and a second inclined surface opposing the first inclined surface, and wherein a slope of the first inclined surface is steeper than that of the second inclined surface.

5. The vehicle antenna mounting system according to claim 1, wherein the cavity includes a retention shoulder provided in the center cavity, and wherein the pair of center legs are engaged with the retention shoulder.

6. The vehicle antenna mounting system according to claim 1, wherein, when the head is received in the upper cavity, a top surface of the head is flush with a top surface of the antenna base.

7. The vehicle antenna mounting system according to claim 1, wherein each edge leg of the pair of edge legs further includes a straight portion extending vertically.

8. The vehicle antenna mounting system according to claim 1, wherein the temporary mounting member includes a head and an opening provided in the head and includes a pair of edge legs extending from opposing edges of the head, respectively, and wherein a screw passes through the opening and is screwed into the antenna base.

9. The vehicle antenna mounting system according to claim 1, further comprising a stopper projection protruding downwardly from a bottom surface of the roof along a peripheral edge of the hole.

10. The vehicle antenna mounting system according to claim 1, wherein the cavity is complementary to the temporary mounting member.

11. A vehicle antenna mounting system, comprising:

an antenna circuit board;

an antenna base supporting the antenna circuit board;

an antenna cover covering the antenna circuit board; and a temporary mounting member temporarily mounting the antenna base on a roof of a vehicle body, wherein the antenna base has a mounting projection protruding downwardly from a bottom surface of the antenna base and has a cavity defined in the mounting projection, wherein the temporary mounting member is received in the cavity, wherein the roof has a hole into which the temporary mounting member is inserted, wherein the temporary mounting member includes a head, a pair of center legs extending from the center of the head, and a pair of edge legs extending from opposing edges of the head, respectively, wherein each edge leg of the pair of edge legs has an inner surface facing the pair of center legs and an outer surface facing the outside of the head, and wherein each edge leg has a plurality of inner recesses provided on the inner surface and has a plurality of outer recesses provided on the outer surface.

12. The vehicle antenna mounting system according to claim 11, wherein the plurality of inner recesses is recessed from the inner surface toward the outer surface, and wherein the plurality of outer recesses is recessed from the outer surface toward the inner surface.

13. The vehicle antenna mounting system according to claim 11, wherein the cavity is complementary to the temporary mounting member.

14. A vehicle antenna mounting system, comprising:

an antenna circuit board;

an antenna base supporting the antenna circuit board;

an antenna cover covering the antenna circuit board; and a temporary mounting member temporarily mounting the antenna base on a roof of a vehicle body, wherein the antenna base has a mounting projection protruding downwardly from a bottom surface of the antenna base and has a cavity defined in the mounting projection, wherein the temporary mounting member is received in the cavity, wherein the roof has a hole into which the temporary mounting member is inserted, wherein the temporary mounting member includes a head, a pair of center legs extending from the center of the head, and a pair of edge legs extending from opposing edges of the head, respectively, wherein the head has a positioning recess, wherein the antenna base has a positioning projection protruding toward the cavity, and wherein, when the temporary mounting member is received in the cavity, the positioning projection is fitted into the positioning recess.

15. The vehicle antenna mounting system according to claim 14, wherein the cavity is complementary to the temporary mounting member.

* * * * *